US010356880B2

(12) United States Patent
Knaapen et al.

(10) Patent No.: US 10,356,880 B2
(45) Date of Patent: Jul. 16, 2019

(54) IDENTIFICATION OF LUMINAIRE PARTS

(71) Applicant: SIGNIFY HOLDING B.V., Eindhoven (NL)

(72) Inventors: Bram Knaapen, Eindhoven (NL); Bartel Marinus Van De Sluis, Eindhoven (NL); Tim Dekker, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 33 days.

(21) Appl. No.: 15/556,204

(22) PCT Filed: Feb. 17, 2016

(86) PCT No.: PCT/EP2016/053354
§ 371 (c)(1),
(2) Date: Sep. 6, 2017

(87) PCT Pub. No.: WO2016/142138
PCT Pub. Date: Sep. 15, 2016

(65) Prior Publication Data

US 2018/0049294 A1 Feb. 15, 2018

(30) Foreign Application Priority Data

Mar. 6, 2015 (EP) ..... 15158075

(51) Int. Cl.
*H05B 37/02* (2006.01)
*H05B 33/08* (2006.01)
*F21V 1/00* (2006.01)

(52) U.S. Cl.
CPC ..... *H05B 37/0227* (2013.01); *H05B 37/0245* (2013.01); *F21V 1/00* (2013.01); *H05B 33/0803* (2013.01)

(58) Field of Classification Search
CPC ..... H05B 37/0227; H05B 37/0245; H05B 37/0254; H05B 37/0281; H05B 37/0272
(Continued)

(56) References Cited

U.S. PATENT DOCUMENTS

2005/0116667 A1* 6/2005 Mueller ..... E04F 13/08 315/312
2005/0174473 A1* 8/2005 Morgan ..... H05B 33/0803 348/370
(Continued)

FOREIGN PATENT DOCUMENTS

WO 2010029459 A1 3/2010
WO 2010092504 A1 8/2010
(Continued)

*Primary Examiner* — Douglas W Owens
*Assistant Examiner* — Syed M Kaiser
(74) *Attorney, Agent, or Firm* — Meenakshy Chakravorty

(57) ABSTRACT

A luminaire for identifying a lamp shade is disclosed. The luminaire comprises a light source (102), a lamp shade (104) and a second luminaire component (108). The lamp shade (104) comprises at least one surface feature (106) which comprises an identifier, the identifier being representative of at least one characteristic of the lamp shade (104). The second luminaire component (108) comprises a detector (110) arranged for detecting the at least (5) one surface feature (106) of the lamp shade (104). The second luminaire component (108) further comprises a first processor (112) arranged for retrieving the identifier from the detected at least one surface feature (106), and for identifying the at least one characteristic of the lamp shade (104) based on the retrieved identifier. This allows the second luminaire component (108) to control, for example, the light output of the light source (102) based on the identified at least (10) one characteristic, or to transmit the retrieved information to a further device for further control or for informative purposes.

14 Claims, 9 Drawing Sheets

(58) Field of Classification Search
USPC ..... 315/158, 297, 307, 122, 192, 224
See application file for complete search history.

(56) References Cited

U.S. PATENT DOCUMENTS

| | | | | |
|---|---|---|---|---|
| 2006/0154642 | A1* | 7/2006 | Scannell, Jr. ..... | A01G 9/02 455/404.1 |
| 2012/0169249 | A1* | 7/2012 | Loveland ..... | H05B 37/0245 315/291 |
| 2012/0235579 | A1* | 9/2012 | Chemel ..... | F21S 2/005 315/152 |
| 2013/0010018 | A1* | 1/2013 | Economy ..... | H05B 37/0272 345/691 |
| 2013/0026947 | A1* | 1/2013 | Economy ..... | H05B 37/0272 315/287 |
| 2014/0301179 | A1 | 10/2014 | Rich et al. | |
| 2016/0374179 | A1* | 12/2016 | Newton ..... | H05B 33/0845 |
| 2016/0374182 | A1* | 12/2016 | Newton ..... | H05B 37/0272 |
| 2017/0038787 | A1* | 2/2017 | Baker ..... | H05B 37/0272 |

FOREIGN PATENT DOCUMENTS

| | | | |
|---|---|---|---|
| WO | 2014001965 | A1 | 1/2014 |
| WO | 2014013377 | A2 | 1/2014 |

* cited by examiner

IDENTIFICATION OF LUMINAIRE PARTS

CROSS-REFERENCE TO PRIOR APPLICATIONS

This application is the U.S. National Phase application under 35 U.S.C. § 371 of International Application No. PCT/EP2016/053354, filed on Feb. 17, 2016, which claims the benefit of European Patent Application No. 15158075.0, filed on Mar. 6, 2015. These applications are hereby incorporated by reference herein.

FIELD OF THE INVENTION

The invention relates to a luminaire and a method for identifying a lamp shade. The invention further relates to a lamp shade and a luminaire component for use in the luminaire.

BACKGROUND OF THE INVENTION

Future and current home and professional environments will contain a large number of controllable luminaires for creation of ambient, atmosphere, accent or task lighting. These luminaires consist of multiple parts, such as light sources, drivers, wiring, sockets, housing and lamp shades. Each of these parts may be produced by a different manufacturer, and the luminaire may be assembled at yet another company or it may be assembled by the user. Furthermore, the developments in digital manufacturing (e.g. 3D printing) enable mass-customization, enabling end-users to specify desired properties of luminaire parts. This results in an infinite number of assembly possibilities, and it may be required that the individual luminaire parts cooperate accordingly (e.g. the light output of a light source may be adjusted to another part of the luminaire). Patent application WO2014001965 A1 describes a lighting unit that adjusts its light output based sensor data, the sensor data being representative of the environmental characteristics of the lighting unit. The sensor data may further be utilized to detect properties of a lighting fixture/luminaire design and adjust at least one of a plurality of light output characteristics based on the detected properties.

Patent application WO 2010029459 A1 relates to an organic light emitting diode (OLED) device comprising a tag element that encodes operating information about the device, for example its maximal driving current, such that this information can be read out wirelessly and/or electrically by wire. It further relates to a socket with a read-out unit for reading out the operating information from such a tag element. The tag element may comprise a tag electrode that can be capacitively coupled to a counter-electrode in the socket. Alternatively, the tag element may be disposed on the surface of the OLED device, thus being freely accessible to read-out sensors.

SUMMARY OF THE INVENTION

It is an object of the present invention to provide a luminaire, a lighting system and a method which enable automatic detection and identification of a lamp shade.

According to a first aspect of the invention the object is achieved by a luminaire. The luminaire comprises:

- a light source,
- a lamp shade comprising at least one surface feature, the at least one surface feature comprising an identifier, which identifier is representative of at least one characteristic of the lamp shade, and
- a second luminaire component comprising:
  - a detector arranged for detecting the at least one surface feature of the lamp shade, and
  - a first processor arranged for retrieving the identifier from the detected at least one surface feature, and for identifying the at least one characteristic of the lamp shade based on the retrieved identifier, wherein the first processor is arranged for adjusting the light output of the light source based on the at least one characteristic of the lamp shade.

The identification of the at least one characteristic of the lamp shade provides the advantage that the first processor of the second luminaire component can, for example, adjust the light output of the light source based on the characteristics of the lamp shade. The lamp shade may, for example, diffuse or reflect the light emitted by the light source, and based on the diffusion or reflaction properties, the first processor may determine how to control the light output of the light source. The at least one surface feature of the lamp shade may be created during the manufacturing of the lamp shade. This is beneficial because when the lamp shade and the second luminaire component are assembled, the second luminaire component immediately knows what type of lamp shade is attached to it. This may further be beneficial when the luminaire components are produced by different manufacturers.

In an embodiment of the luminaire, the at least one surface feature is embedded in the surface of the lamp shade. It may be embedded in the surface during manufacturing of the lamp shade. The manufacturer may have access to specific information about the lamp shade. The information may be embedded in its surface in the form of the at least one surface feature, which is advantageous because it may provide any second luminaire component with detection means the possibility to retrieve the information automatically.

In an embodiment of the luminaire, the at least one surface feature comprised in the lamp shade comprises a protrusion and/or a depression in the surface of the lamp shade, which protrusion and/or depression comprises the identifier, and the detector is arranged for detecting the protrusion and/or depression so as to detect the identifier. Protrusions and depressions are types of surface features that are easily created in a surface during a manufacturing process. Both protrusions and depressions can be easily created when additive manufacturing technologies (such as 3D printing) are used. Furthermore, depressions may be beneficial for subtractive manufacturing technologies more (such as turning, milling, drilling, etc.). This, however, does not exclude the creation of protrusions during subtractive manufacturing.

In an embodiment of the luminaire, the at least one surface feature comprised in the lamp shade is of a color different from the color of the lamp shade, which difference in color is representative of the identifier, and the detector is arranged for detecting the difference in color so as to detect the identifier. The different color of the at least one surface feature may be created during the manufacturing process (e.g. by (3D) color printing) or the different color may be, for example, painted/stamped on the surface afterwards. The advantage of using color is that it may be a cost efficient way to create the at least one surface feature.

In an embodiment of the luminaire, the light source is further arranged for illuminating at least a part of the at least one surface feature, and the detector comprises an optical sensing unit arranged for detecting the at least a part of the at least one surface feature. Illuminating at least a part of the at least one surface feature is advantageous because it may increase the detectability of the at least one surface feature, thus increasing the accuracy of detecting the identifier. Using the light emitted by the light source to illuminate the at least one surface feature is beneficial because the light source is already located at the second luminaire component, thereby reducing the requirement for an additional light source for illuminating the at least one surface feature.

In an alternative embodiment of the luminaire, the detector comprises a further light source arranged for illuminating at least a part of the at least one surface feature, and the detector comprises an optical sensing unit arranged for detecting the at least a part of the at least one surface feature. In embodiments, an additional light source may be required to illuminate the at least one surface feature, for example when the translucency of the at least one surface feature material is used to detect the identifier, and when the light source of the second luminaire component cannot illuminate the at least one surface feature.

In an embodiment of the luminaire, at least a part of the at least one surface feature comprised in the lamp shade contains a conductive material with conductive properties different from the conductive properties of the material of the lamp shade, and wherein the detector is arranged for detecting the conductive material so as to detect the identifier. In this embodiment capacitive sensing may be used to detect the material properties of the at least one surface feature to retrieve the identifier from the lamp shade.

In an embodiment of the luminaire, at least a part of the detector is physically connected to the at least one surface feature. A physical connection may be beneficial because it may simplify detecting the at least one surface feature by the detector. For some embodiments of the luminaire, a physical connection may be advantageous because it may increase the accuracy of detection of the at least one surface feature, thereby providing more accurate information for the first processor.

In an embodiment of the luminaire, the at least one characteristic comprises information about at least one of the group comprising:

a type of lamp shade, a code of the lamp shade, a light distribution of the lamp shade, and a light setting for the lamp shade.

The first processor of the second luminaire component is arranged for adjusting the light output of the light source based on the at least one characteristic. The benefit of adjusting the light output of the light source based on the at least one characteristic is that the light output may be optimized. This may reduce power consumption of the luminaire and it may remove the step of manually configuring the light output of the light source, thereby improving the usability of the luminaire.

According to a second aspect of the invention the object is achieved by a lighting system. The lighting system comprises:

the luminaire of any one of the claims 1 to 10, wherein the first processor is further arranged for generating a signal based on the retrieved identifier, and a first device arranged for receiving the signal, the first device comprising a second processor arranged for identifying the at least one characteristic of the lamp shade based on the received signal.

It is beneficial if the second luminaire component is able to communicate the identifier to the first device because it can communicate to the first device what type of lamp shade is located at the second luminaire component.

In an embodiment of the lighting system, the second processor is further arranged for generating a control command based on the identified at least one characteristic, and the first processor is further arranged for adjusting the light output of the light source based on the control command. This embodiment allows the first device to control the light output of the lighting system based on the identified lamp shade. This may be beneficial for example in a networked system wherein a central controller controls the light output of the luminaire of the system.

In an embodiment of the lighting system, the first device further comprises a user interface arranged for providing information to a user about the lamp shade, wherein the information is based on the at least one characteristic. The user interface may communicate, for example, the type of lamp shade to the user, allowing the user to make light output related decisions based on the type of lamp shade. It further provides the user with information about the luminaire components present in the system. The advantage of communicating information about the luminaire components to the user is that it may enhance the interactivity between the user and the lighting system.

In a further embodiment of the lighting system, the user interface is further arranged for receiving a user input related to adjusting the light output of the light source. The second processor may be further arranged for generating a user control command based on the user input and the first device may be further arranged for transmitting the user control command via a transmitter. The second luminaire component may be further arranged for receiving the user control command, and the first processor may be further arranged for adjusting the light output of the light source based on the received user control command. This embodiment allows the user to control the light output of the light source of the lighting system, and it allows the user to make decisions regarding the light output, based on the at least one characteristic of the lamp shade.

According to a second aspect of the invention the object is achieved by a method of identifying a lamp shade. The method comprises the steps of:

providing a lamp shade comprising at least one surface feature, the at least one surface feature comprising an identifier, which identifier is representative of at least one characteristic of the lamp shade, providing a second luminaire component, detecting, by the second luminaire component, the at least one surface feature of the lamp shade, retrieving the identifier from the detected at least one surface feature, and identifying the at least one characteristic of the lamp shade based on the retrieved identifier, and controlling the light output of a light source based on the at least one characteristic of the lamp shade.

BRIEF DESCRIPTION OF THE DRAWINGS

The above, as well as additional objects, features and advantages of the disclosed devices, systems and methods, will be better understood through the following illustrative and non-limiting detailed description of the embodiments of the systems, devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
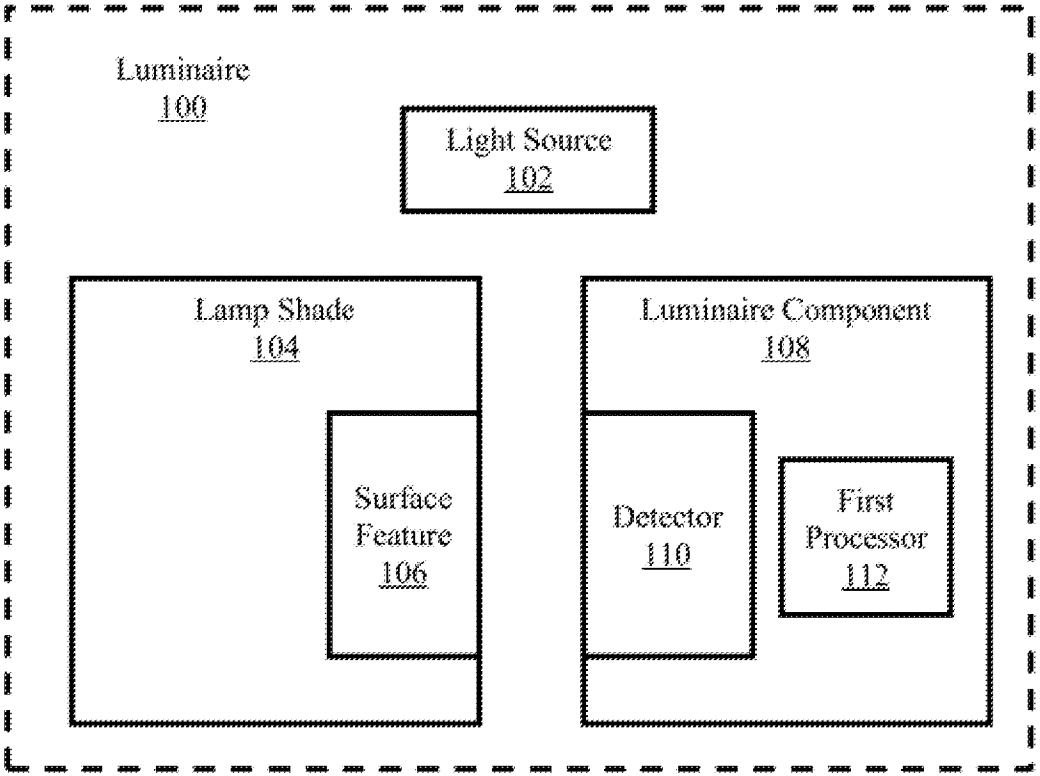
FIG. 1 shows schematically an embodiment of a luminaire according to the invention, the luminaire comprising a light source, a first luminaire component and a second luminaire component.

FIG. 1 shows schematically an embodiment of a luminaire 100 according to the invention, the luminaire 100 comprising a light source 102, a lamp shade 104 and a second luminaire component 108. The lamp shade 104 comprises at least one surface feature 106 which comprises an identifier, the identifier being representative of at least one characteristic of the lamp shade 104. The second luminaire component 108 comprises a detector 110 arranged for detecting the at least one surface feature 106 of the lamp shade 104. The second luminaire component 108 further comprises a first processor 112 arranged for retrieving the identifier from the detected at least one surface feature 106, and for identifying the at least one characteristic of the lamp shade 104 based on the retrieved identifier. This allows the second luminaire component 108 to control, for example, the light output of the light source 102 based on the identified at least one characteristic, or to transmit the retrieved information to a further device for further control or for informative purposes.

The lamp shade 104 can be any type of lamp shade to be connected/attached to the second luminaire component 108. In a first example, the at least one surface feature 106 may be, for example, embedded in the lamp shade or be located at the interconnection between the lamp shade and the second luminaire component 108 (e.g. an LED module). Alternatively, the at least one surface feature 106 may be, for example, stamped or printed on any part of the lamp shade (e.g. on the lamp shade itself, on connector parts, etc.). In a second example, the lamp shade 104 may be a diffuser of an LED luminaire. The at least one surface feature 106 may, for example, be embedded in the surface of the diffuser, detectable by the detector 110 of the second luminaire component 108 (e.g. an LED module). The second luminaire component 108 can be any type of luminaire component to be connected/attached to the lamp shade 104.

The first processor 112 of the second luminaire component 108 is arranged for retrieving the identifier from the detected at least one surface feature 106 and for identifying the at least one characteristic of the lamp shade 104 based on the retrieved identifier. The first processor 112 may be connected to a database wherein a list of identifiers is stored, wherein each stored identifier may comprise information about a specific lamp shade. The database may be stored on a device at a location remote from the luminaire 100, for example on a remote server. The first processor 112 may be connected to the remote server via a communication network to retrieve the at least one characteristic of the lamp shade 104 based on the identifier.

The at least one characteristic may for example comprise information about the type of lamp shade 104. The type can be, for example, a diffusive lamp shade, a reflective lamp shade, etc. The type may further provide information about the color of the lamp shade, its reflective and/or its diffusive properties.

Additionally or alternatively, the at least one characteristic may comprise a code of the lamp shade 104. The code may be a product code (for example indicative of a product type), a unique product code (e.g. a serial number), etc. The first processor 112 may, for example, communicate this code to a further device to inform the further device about the product type or serial number of the luminaire component.

Additionally or alternatively, the at least one characteristic may further comprise a light setting for the lamp shade 104. The light setting may for example be a light setting that matches an identified lamp shade, a light setting that matches an identified light diffuser, a light setting that matches an identified fixture and/or a light setting that matches an identified reflector or lens.

The light source 102 of the luminaire 100 may be any type of light source 102 arranged for emitting light. The light source 102 may be arranged for emitting light for general illumination, atmosphere creation, task lighting, etc. The light source 102 may be for example an LED light source 102, an incandescent light source 102, a fluorescent light source 102 or a high-intensity discharge light source 102. The light source 102 may be arranged for emitting a plurality of colors, color temperatures and/or light intensities. The light source 102 may be controlled by the first processor 112 of the second luminaire component 108, or the light source 102 may be controlled by any other type of control device (e.g. by an internal processor 112, an external processor 112, etc.).

The lamp shade 104 comprises the at least one surface feature 106. The at least one surface feature 106 may be attached/embedded/created during the manufacturing process of the lamp shade 104. Alternatively, the at least one surface feature 106 may be attached/embedded/created after the lamp shade 104 has been manufactured. This may provide the advantage that an intermediary manufacturer or assembler may attach/embed/create the at least one surface feature 106.

In an embodiment, the at least one surface feature 106 may be attached to the lamp shade 104 after it has been manufactured. The at least one surface feature 106 may be, for example, a QR code or a barcode. The QR code may be printed on a sticker which is attached to the surface of the lamp shade 104. The QR code may also be stamped or printed on the surface of the lamp shade. In this embodiment, the detector 110 may comprise a QR code/barcode reader. The processor 112 may identify the luminaire component 104 based on the readings of the QR code/barcode reader.

In an embodiment, the at least one surface feature 106 is embedded in the surface of the of the lamp shade 104. The at least one surface feature 106 may be embedded during the manufacturing process of the lamp shade 104. Often, the manufacturer has information about the lamp shade 104 before manufacturing the component. This information can be encoded and be translated into the at least one surface feature 106. The at least one surface feature 106 may also be representative of a code stored in a database, wherein the database may comprise the information of the lamp shade 104. Therefore, it may be advantageous if the at least one surface feature 106 is created during the manufacturing of the lamp shade 104, for example via 3D printing. The at least one surface feature 106 may be integrated in the 3D model of the lamp shade 104, and therefore be created when the 3D model is printed. Alternatively, the at least one surface feature 106 may be embedded in the surface in a subtractive manufacturing process, such as milling, drilling or turning. Also here the lamp shade 104 is often manufactured based on a computer model, and the at least one surface feature 106 may be part of the computer model.

Figure 2:
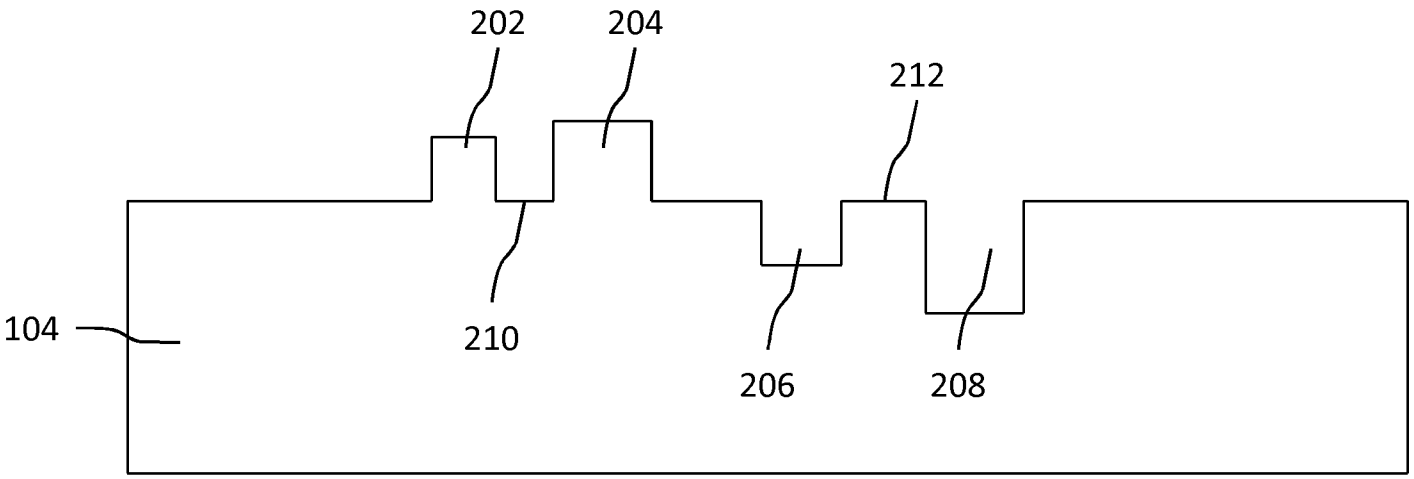
FIG. 2 shows schematically a cross-section of a first luminaire component with protruded surface features and depressed surface features.

FIG. 2 shows schematically an embodiment of a lamp shade 104 with protruded surface features 202, 204 and depressed surface features 206, 208. The lamp shade 104 may comprise protruded features 202, 204, depressed features 206, 208 or a combination of both. The protruded surface features 202, 204 may have same height, width and depth, or they may vary in height, width and depth. The distance 210 between the protruded surface features 202, 204 may be similar for each surface feature 202, 204 or it may vary between surface features 202, 204. Similarly, the depressed surface features 206, 208 may have same height, width and depth, or they may vary in height, width and depth. Also, the distance 212 between the depressed surface features 206, 208 may be similar for each surface feature 206, 208 or it may vary between surface features 206, 208. FIG. 2 shows cubical surface features 202, 204, 206, 208, but the surface features may have any shape (e.g. spherical, concave, convex, oval, triangular, etc.). In an embodiment, the detector 110 may be physically connected to the surface features 202, 204, 206, 208. The detector 110 may comprise switches that are pressed by the different surface features, thereby detecting the protrusion/depression height of each surface feature 202, 204, 206, 208. The first processor 112 may further identify the at least one characteristic of the lamp shade 104 based on signals received from the switches.

Figure 3:
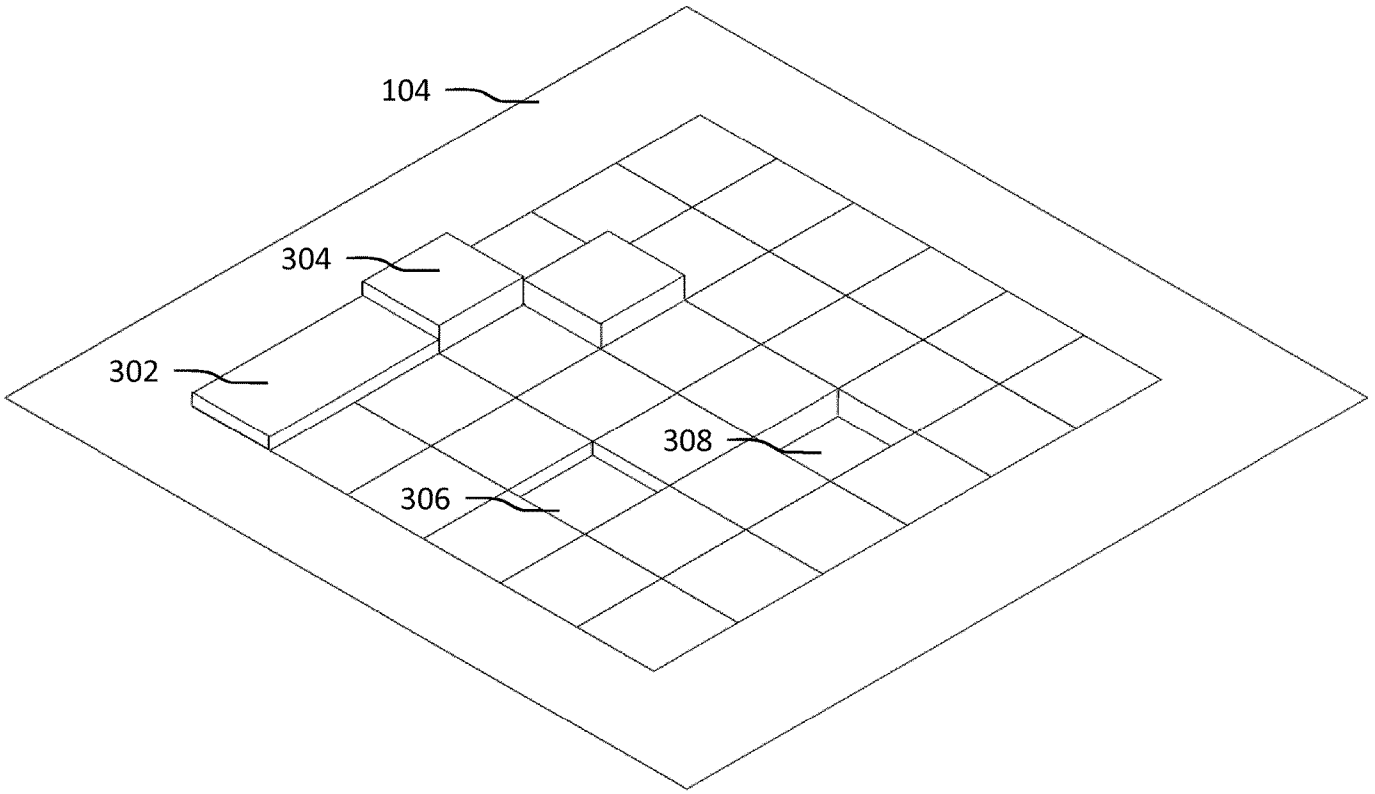
FIG. 3 shows schematically another embodiment of a first luminaire component with protruded surface features and depressed surface features.

FIG. 3 shows schematically another embodiment of a lamp shade 104 with protruded surface features 302, 304 and depressed surface features 306, 308. The surface features 302, 304, 306, 308 may form the identifier based on their location, protrusion, depression, size, inter-surface distance, etc. FIG. 3 shows cubical surface features 106, but the surface features 106 may have any shape (e.g. spherical, concave, convex, oval, triangular, star-shaped, trapezoid-shaped, etc.).

In an embodiment, the at least one surface feature 106 comprised in the lamp shade 104 is of a color different from the color of the lamp shade 104. The color of the at least one surface feature 106 may be different because the material of the at least one surface feature 106 is different from the material of the lamp shade 104. Additionally or alternatively, the color may be printed or stamped on the surface of the lamp shade 104. In the embodiment wherein the lamp shade 104 is manufactured via a 3D printing process, the difference in color may be created by the 3D printer by printing the at least one surface feature 106 in a color different from the color of the lamp shade 104.

In an embodiment, the light source 102 of the luminaire 100 is arranged for illuminating at least a part of the at least one surface feature 106. The detector 110 comprises an optical sensing unit arranged for detecting the at least a part of the at least one surface feature 106. The optical sensing unit may be for example a camera, a phototransistor or a plurality of phototransistors in order to detect the surface features 106. The differences in reflectance of the surface features 106 and/or the creation of shadows of the surface features 106 may be detected by the optical sensing unit of the detector 110.

Figure 4:
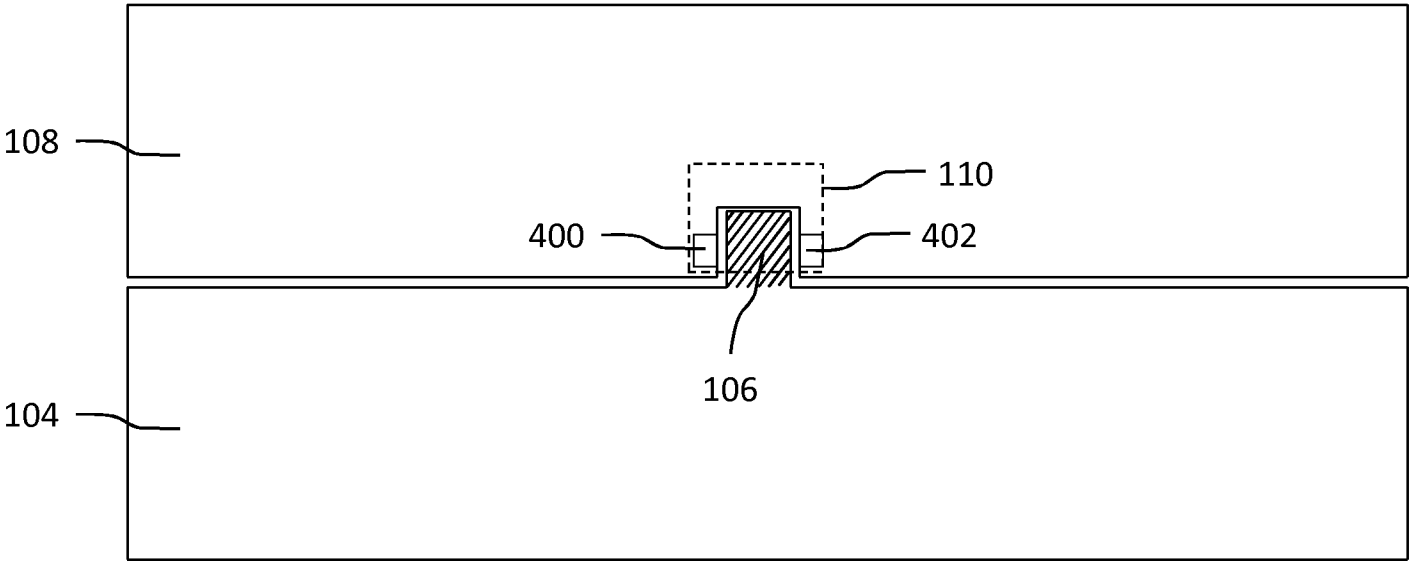
FIG. 4 shows schematically a cross-section of a first luminaire component with a protruded surface feature and a second luminaire component with a detection unit and a further light source arranged for illuminating at least a part of the at least one surface feature.

Alternatively, the detector 110 may comprise a further light source 400 arranged for illuminating at least a part of the at least one surface feature 106. The detector may further comprise an optical sensing unit 402 arranged for detecting the at least one surface feature 106. FIG. 4 illustrates an exemplary embodiment, wherein the optical sensing unit 402 detects for example the translucency of the at least one surface feature 106, whereafter the first processor 112 may identify the at least one characteristic of the lamp shade 104. The detector 110 may comprise a plurality of light sources 400 and/or a plurality of optical sensing units 402 in order to detect a plurality of surface features 106. Alternatively, the detector 110 may be arranged for detecting the presence and absence of a surface feature 106 based on the amount of light that is detected by the optical sensing unit 402, which may be indicative of a part of the identifier of the lamp shade 104.

Figure 5B:
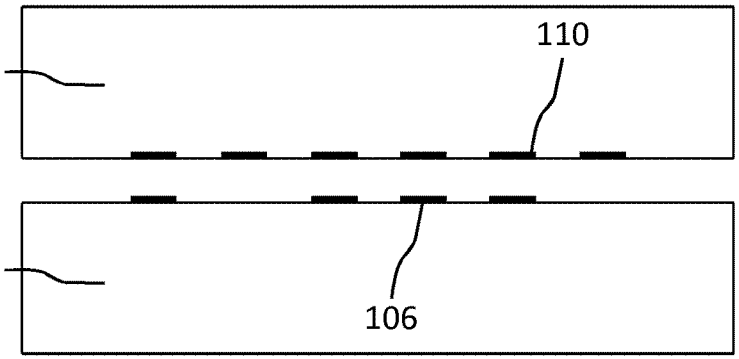
FIG. 5*b* shows schematically a cross-section of a first luminaire component with surface features comprised in the first luminaire component containing a material with material properties different from the material properties of the first luminaire component, and a second luminaire component with a plurality of detection areas.
Figure 5A:
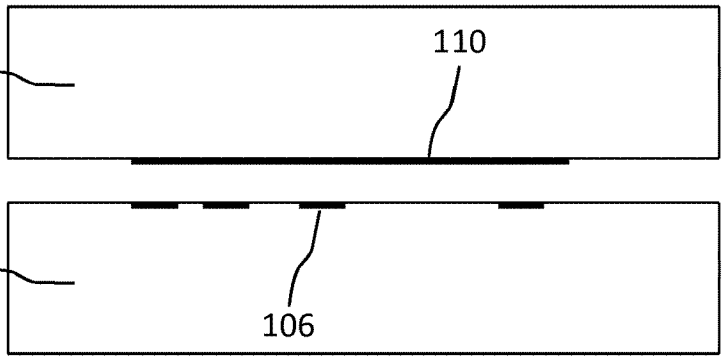
FIG. 5*a* shows schematically a cross-section of a first luminaire component with surface features comprised in the first luminaire component containing a material with material properties different from the material properties of the first luminaire component, and a second luminaire component with a detection area.

In an embodiment, at least a part of the at least one surface feature 106 comprised in the lamp shade 104 contains a material with material properties different from the material properties of the lamp shade 104, and wherein the detector 110 is arranged for detecting at least one material property. FIG. 5*a* shows schematically a cross-section of a lamp shade 104 with surface features 106 comprised in the lamp shade 104 containing a material (e.g. a conductive metal) with material properties different from the material properties of the lamp shade 104 (e.g. a plastic luminaire component), and a second luminaire component 108 with a detection area. In this example, the at least one surface feature's material may be embedded in the surface. The detector 110 may comprise a capacitive surface (e.g. an x-y grid pattern to detect multiple capacitive surface features 106) arranged for detecting for example a conductive material (e.g. metals, conducting polymers, graphite, etc.). FIG. 5*b* shows an embodiment wherein the detector 110 comprises a plurality of capacitive surfaces/capacitive sensors in order to detect the presence/absence/capacitivity of the capacitive surface features 106. In this embodiment, the surface features 106 are located on top of the surface of the lamp shade 104. The surface features 106 may be attached to the surface during the manufacturing process of the lamp shade 104, or they may be attached afterwards.

In an embodiment, at least a part of the detector 110 is physically connected to the at least one surface feature 106.

Figure 6:
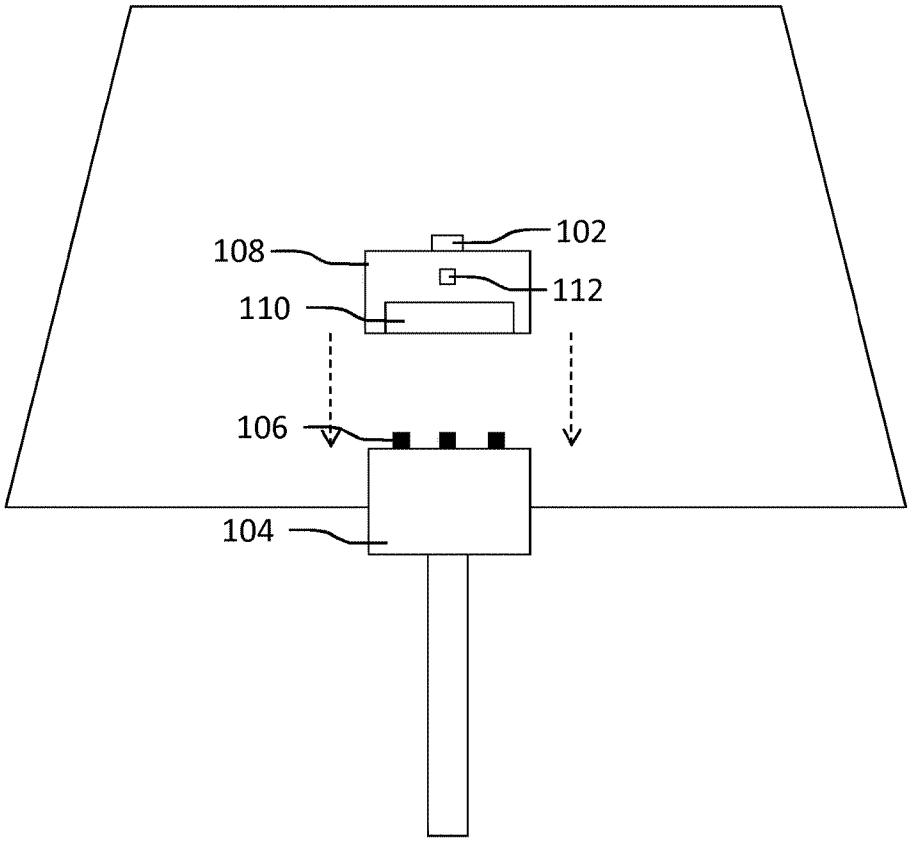
FIG. 6 shows schematically an embodiment of a luminaire according to the invention.

For some of the above-mentioned embodiments it may be required that the detector 110 is physically connected to the at least one surface feature 106. FIG. 6 illustrates such an embodiment. The detector 110 connects physically to the at least one surface feature 106. In this embodiment, the at least one surface feature 106 is located on a module that is connected to the lamp shade. The at least one surface feature 106 may comprise an identifier that comprises information about the lamp shade. The detector 110 of the second luminaire component 108 detects the at least one surface feature 106 of the lamp shade 104, and the first processor 112 of the lamp shade 104 may identify the lamp shade. Upon identifying the lamp shade, the first processor 112 of the second luminaire component 108 may adjust the light output of the light source 102 based on the characteristics of the lamp shade.

Figure 7:
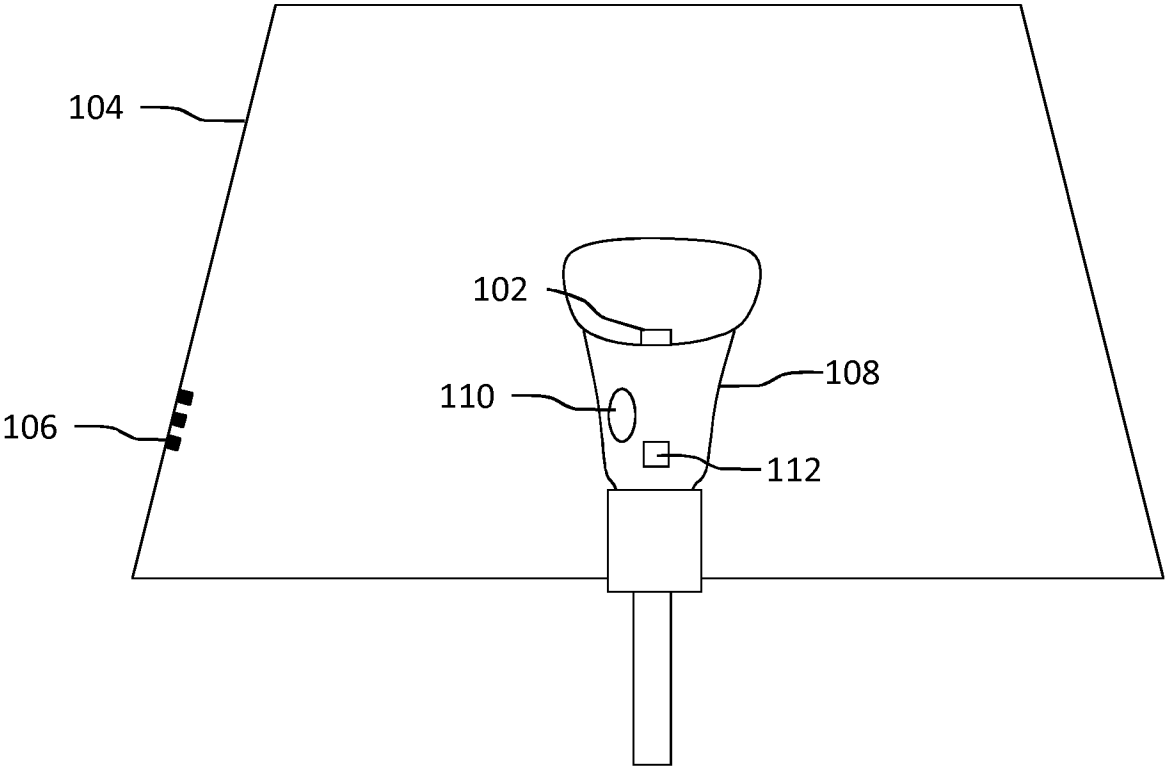
FIG. 7 shows schematically another embodiment of a luminaire according to the invention.

FIG. 7 shows schematically another embodiment of a luminaire according to the invention. In this embodiment, the at least one surface feature 106 is located at the lamp shade, and the detector 110 of the second luminaire component 108 comprises a means for remotely detecting the at least one surface feature 106. The detector 110 may, for example, comprise a camera that takes an image of the at least one surface feature 106. The first processor 112 may use digital image processing in order to recognize the code and to retrieve the identifier. In another example, the detector 110 may be a scanner that scans the reflected light from the at least one surface feature 106, and the first processor 112 may interpret the signals received from the scanner in order to retrieve the identifier of the lamp shade. The detector 110 may comprise a further light source to illuminate the at least one surface feature 106, or the light source 102 of the luminaire 100 may illuminate the at least one surface feature 106. Furthermore, the retrieved identifier may be compared with identifiers stored in a database in order to determine, for example, the type of lamp shade.

Figure 8:
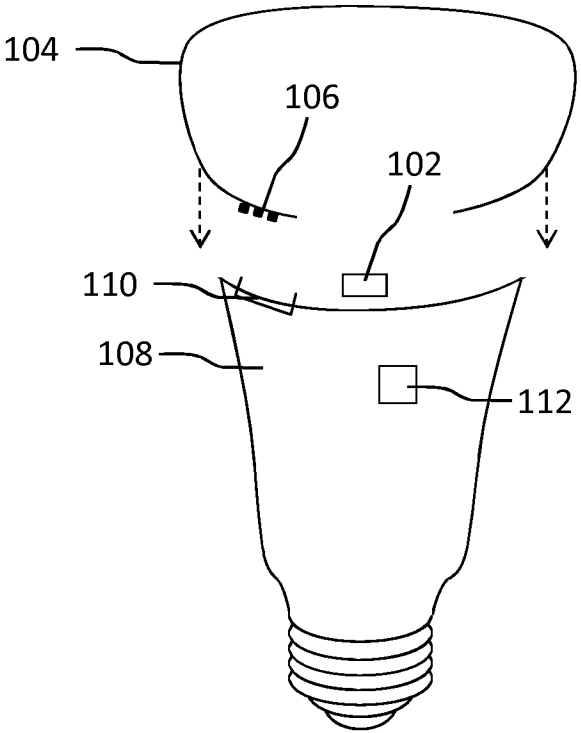
FIG. 8 shows schematically another embodiment of a luminaire according to the invention.

FIG. 8 shows schematically another embodiment of a luminaire 100 according to the invention. The luminaire comprises a light diffuser comprising at least one surface feature 106 according to any one of the above-mentioned surface features 106. Furthermore, the luminaire comprises a second luminaire part, comprising the detector 110, the first processor 112 and the light source 102. The detector 110 may, according to any one of the above-mentioned detection methods, detect the at least one surface feature 106 of the light diffuser. Upon detecting the type of light diffuser, the first processor 112 may adjust the light output of the light source 102 to match the characteristics of the diffuser.

Figure 9:
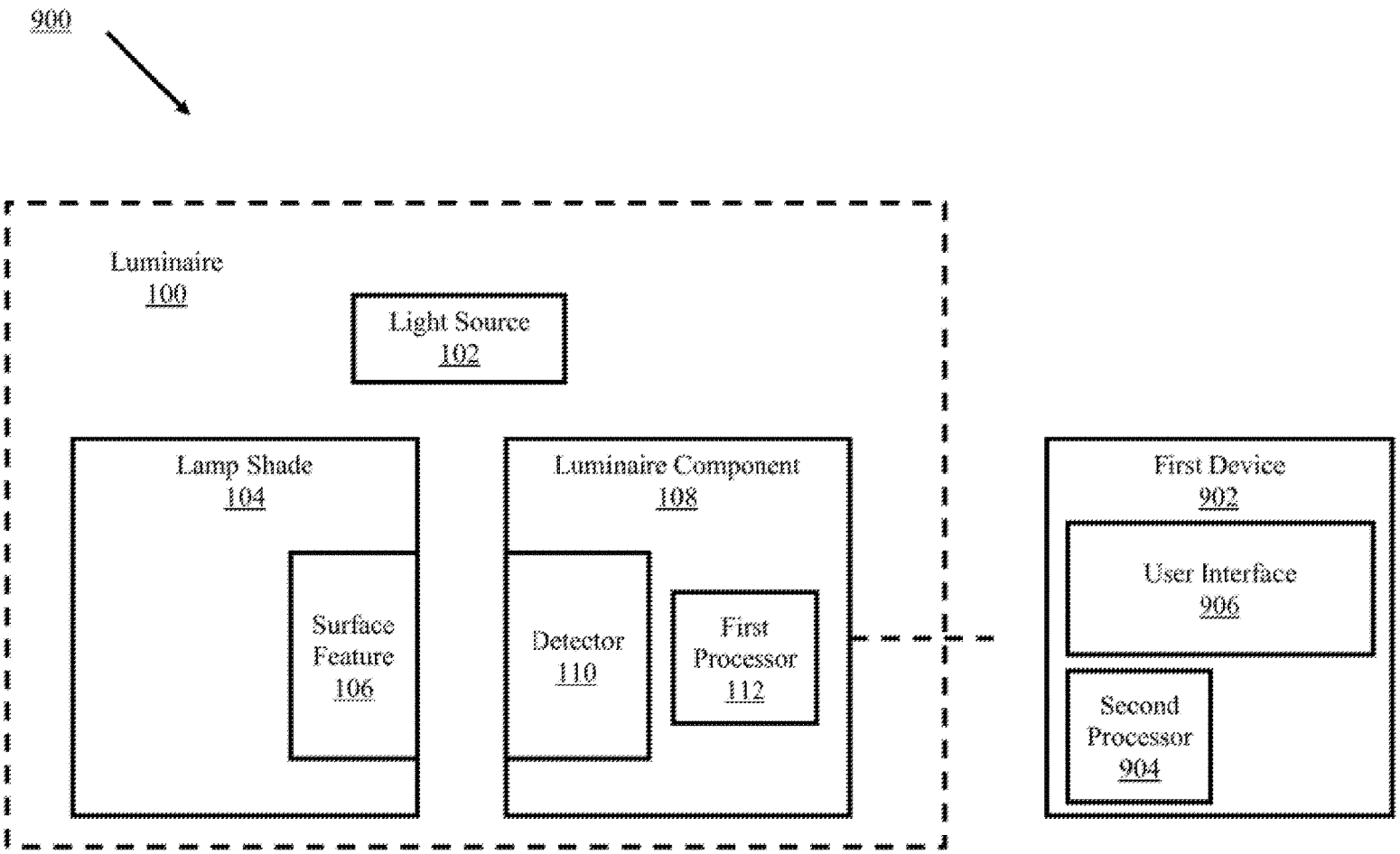
FIG. 9 shows schematically an embodiment of a lighting system according to the invention.

FIG. 9 shows schematically an embodiment of a lighting system 900 according to the invention. The lighting system 900 comprises the luminaire 100 according to the luminaire of any one of the above-mentioned embodiments. The first processor 112 of the second luminaire component 108 is further arranged for generating a signal based on the retrieved identifier. The second luminaire component 108 may comprise a transmitter/transceiver in order to transmit the signal. The lighting system 900 further comprises a first device 902 (e.g. a smart phone, a tablet pc, a smart watch, smart glasses, etc.) arranged for receiving the signal via a receiver/transceiver. The first device 902 further comprises a second processor 904 arranged for identifying the at least one characteristic of the lamp shade 104 based on the received signal. The second luminaire component 108 and the first device 902 may communicate via any communication technology. Various wireless communication technologies that are known in the art may be used, for example Bluetooth, Wi-Fi or ZigBee. A specific communication technology may be selected based on the communication capabilities of the second luminaire component 108 and the first device 902, the power consumption of the communication driver for the wireless technology and/or the communication range of the wireless signals. Many consumer devices today are already equipped with one or more wireless communication technologies, which is advantageous because this may reduce the effort to create a communication link between the second luminaire component 108 and the consumer device (i.e. the first device 902).

In an embodiment, the first device 902 is arranged for controlling the light output of the luminaire 100. In this embodiment, the second processor 904 is further arranged for generating a control command based on the identified at least one characteristic. The characteristic may be, for example, a specific light distribution of the lamp shade 104 (or a diffuser), whereupon the second processor 904 may determine to transmit a light setting/scene according to the specific light distribution. The second luminaire component 108 may receive this light setting/scene and adjust the light output of the light source 102 of the luminaire 100, thereby possibly creating an optimal light effect.

In an embodiment, the first device 902 further comprises a user interface 906 arranged for providing information to a user about the lamp shade 104. The information may be based on the at least one characteristic. The user interface 906, for example a display, may show the type of lamp shade 104. The user interface 906 may further provide control options for the user related to the at least one characteristic, for example optimal light settings, control settings for the lamp shade 104 and/or control settings for the second luminaire component 108, etc. The user interface 906 may be further arranged for receiving a user input related to adjusting the light output of the light source 102. The second processor 904 may be further arranged for generating a user control command based on the user input and the first device 902 may be further arranged for transmitting the user control command. The second luminaire component 108 may be further arranged for receiving the user control command and the first processor 112 may be further arranged for adjusting the light output of the light source 102 based on the received user control command. Thus, allowing the user to control the light output of the light source 102.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A luminaire, comprising:

a light source;

a lamp shade comprising at least one surface feature, the at least one surface feature comprising an identifier, which identifier is representative of at least one characteristic of the lamp shade; and a luminaire component, comprising:

a detector, arranged for detecting the at least one surface feature of the lamp shade; and a first processor arranged for retrieving the identifier from the detected at least one surface feature, and for identifying the at least one characteristic of the lamp shade based on the retrieved identifier, the first processor arranged for retrieving the at least one characteristic from a database, wherein the first processor is arranged for controlling the light output of the light source based on the at least one characteristic of the lamp shade.

2. The luminaire of claim 1, wherein the at least one surface feature is embedded in the surface of the lamp shade.

3. The luminaire of claim 1, wherein the at least one surface feature comprised in the lamp shade comprises a protrusion and/or a depression in the surface of the lamp shade, which protrusion and/or depression comprises the identifier, and wherein the detector is arranged for detecting the protrusion and/or depression so as to detect the identifier.

4. The luminaire of claim 1, wherein the light source is arranged for illuminating at least a part of the at least one surface feature, and wherein the detector comprises an optical sensing unit arranged for detecting the at least a part of the at least one surface feature.

5. The luminaire of claim 1, wherein the detector comprises a further light source arranged for illuminating at least a part of the at least one surface feature, and wherein the detector comprises an optical sensing unit arranged for detecting the at least a part of the at least one surface feature.

6. The luminaire of claim 1, wherein at least a part of the at least one surface feature comprised in the lamp shade contains a conductive material with conductive properties different from the conductive properties of the material of the lamp shade, and wherein the detector is arranged for detecting the conductive material so as to detect the identifier.

7. The luminaire of claim 1, wherein at least a part of the detector is physically connected to the at least one surface feature.

8. The luminaire of claim 1, wherein the at least one characteristic comprises information about at least one of the group comprising:

a type of lamp shade, a code of the lamp shade, a light distribution of the lamp shade, and a light setting for the lamp shade.

9. A lighting system, comprising:

the luminaire of claim 1, wherein the first processor is further arranged for generating a signal based on the retrieved identifier; and a first device arranged for receiving the signal, the first device comprising a second processor arranged for identifying the at least one characteristic of the lamp shade based on the received signal.

10. The lighting system of claim 9, wherein the second processor is further arranged for generating a control command based on the identified at least one characteristic, and wherein the first processor is further arranged for adjusting the light output of the light source based on the control command.

11. The lighting system of claim 9, wherein the first device further comprises a user interface, wherein the user interface is further arranged for providing information to a user about the lamp shade, the information based on the at least one characteristic.

12. A luminaire, comprising:

a light source;

a lamp shade comprising at least one surface feature, the at least one surface feature comprising an identifier, which identifier is representative of at least one characteristic of the lamp shade; and a luminaire component, comprising:

detector, arranged for detecting the at least one surface feature of the lamp shade; and a first processor arranged for retrieving the identifier from the detected at least one surface feature, and for identifying the at least one characteristic of the lamp shade based on the retrieved identifier, wherein the first processor is arranged for controlling the light output of the light source based on the at least one characteristic of the lamp shade, and wherein the at least one surface feature comprised in the lamp shade is of a color different from the color of the lamp shade, which difference in color is representative of the identifier, and wherein the detector is arranged for detecting the difference in color so as to detect the identifier.

13. A luminaire component, comprising:

a detector, arranged for detecting at least one surface feature of a lamp shade, the at least one surface feature comprising an identifier, which identifier is representative of at least one characteristic of the lamp shade; and a first processor arranged for retrieving the identifier from the detected at least one surface feature, and for identifying the at least one characteristic of the lamp shade based on the retrieved identifier, the first processor arranged for retrieving the at least one characteristic from a database, wherein the first processor is arranged for controlling the light output of a light source based on the at least one characteristic of the lamp shade.

14. A method of identifying a lamp shade, the method comprising the steps of:

providing the lamp shade comprising at least one surface feature, the at least one surface feature comprising an identifier, which identifier is representative of at least one characteristic of the lamp shade;

providing a luminaire component;

detecting, by the luminaire component, the at least one surface feature of the lamp shade;

retrieving the identifier from the detected at least one surface feature;

identifying the at least one characteristic of the lamp shade based on the retrieved identifier;

retrieving the at least one characteristic of the lamp shade from a database; and controlling the light output of a light source based on the at least one characteristic of the lamp shade.

* * * * *